US005803252A

United States Patent [19]

Huo-Chuan

[11] Patent Number: 5,803,252

[45] Date of Patent: Sep. 8, 1998

[54] SYSTEMATIC IRON GOLF CLUB HANGER DEVICE

[76] Inventor: Chen Huo-Chuan, No. 1-2, Alley 44, Lane 148, Yuanshan Rd., Chungho City, Taipei Hsien, Taiwan

[21] Appl. No.: 783,493

[22] Filed: Jan. 14, 1997

[51] Int. Cl.[6] ..... A63B 55/00

[52] U.S. Cl. ..... 206/315.6; 206/315.2; 211/70.2

[58] Field of Search ..... 206/315.2, 315.6; 211/70.2

[56] References Cited

U.S. PATENT DOCUMENTS

| | | | |
|---|---|---|---|
| 1,849,610 | 3/1932 | Boyce | 206/315.6 |
| 2,436,687 | 2/1948 | Corbett | 206/315.6 |
| 3,667,078 | 6/1972 | Distasio | 206/315.6 X |
| 4,666,038 | 5/1987 | Minneman | 206/315.2 |
| 4,960,212 | 10/1990 | Wu | 211/70.2 |
| 5,383,555 | 1/1995 | Weinmeier | 206/315.6 |
| 5,617,951 | 4/1997 | Wick | 206/315.2 X |
| 5,620,091 | 4/1997 | Larson | 206/315.6 |

*Primary Examiner*—Sue A. Weaver
*Attorney, Agent, or Firm*—Peterson, Wicks, Nemer & Kamrath, P.A.

[57] ABSTRACT

A systematic iron golf club hanger device includes a tilted base plate, and clamps are provided under the two ends and the middle of the base plate for clamping on the top of a golf bag. The base plate is tilted in a certain angle relative to a horizontal plane and is provided with many elastic clips to form many clamping portions. The elastic clips are formed by extensions of the base plate. The extensions forming the elastic clips are folded back downwards to form their respective pending portions which keep a short distance from the surface of the base plate. The angles formed between the extensions and the pending portions are determined by the clubs to be clamped. The whole device can firmly clamp every club to prevent damage by collision among the club heads and suits various sizes of golf bags.

20 Claims, 9 Drawing Sheets

SYSTEMATIC IRON GOLF CLUB HANGER DEVICE

BACKGROUND OF THE INVENTION

1. Field of the Invention

The present invention relates to a systematic iron golf club hanger device, and especially to a systematic iron golf club hanger device which can firmly clamp golf clubs in positions and prevent them from being damaged by collision among themselves, which also allows golf clubs to be taken out and put in quickly, and which suits all sizes of bags for golf clubs available on the market.

2. Description of the Prior Art

A golfer normally uses a standard golf bag which is divided into three sections, i.e. the upper, the middle and the lower sections. The upper section is for placing therein three wooden golf clubs having specific club heads. The middle section is for placing nine iron clubs. The lower section is for placing one putting club knitwear covers are put on the three wooden golf clubs in the upper section for carrying and packing thereof. Ordinarily, many, golf clubs are put together into the golf bag. However, simply placing many golf clubs into the golf bag is not only inconvenient when taking them out for use, but also subjects them to damage by collision among the golf club heads and thereby creates cracks or ragged portions thereon. Yet, every golfer needs to sort and count his own golf club set after playing. The golf clubs are in a mess normally at this time, and often some are lost.

In view of this, sorting hangers have been designed. Some prior sorting hangers. are systematical for sorting and placing many golf clubs. Such sorting hangers are not very reliable in positioning the golf clubs when the respective clubs are placed therein, and damage of the golf club heads by collision among themselves may still be induced. More importantly, the conventional sorting hangers used in golf bags have their fixed shape and do not suit the various sizes of mouths of golf bags.

SUMMARY OF THE INVENTION

The principal object of the present invention is to provide a systematic iron golf club hanger device having a tilted base plate provided on the top of the mouth of a golf bag. The tilted base plate is integrately provided with a plurality of elastic clips along the length thereof to form a plurality of clamping portions to clamp a plurality of golf clubs. The elastic clips are formed by extensions of the tilted base plate. These extensions are folded back to be used to clamp the golf clubs firmly in position.

Another object of the present invention is to provide a systematic iron golf club hanger device wherein the tilted base plate thereof is provided with a long and a short sheet bracket on the two ends for mounting a plurality of adjustable clamps. A slide connecting seat extends therefrom at the middle thereof. Therefor the whole club hanger device can suit various sizes of mouths of golf bags.

A further object of the present invention is to provide a systematic iron golf club hanger device wherein the number of elastic clips provided along the length of the tilted base plate is reduced. One adjustable sheet bracket thereon is integrally provided with a set of elastic clips by extension thereof for placing a plurality of specific golf clubs in a specific sized mouth of golf a bag.

The present invention will be apparent in its further objects, characteristics and functions after reading the detailed description of the preferred embodiments thereof in reference to the accompanying drawings.

DETAILED DESCRIPTION OF THE PREFERRED EMBODIMENT

Figure 1:
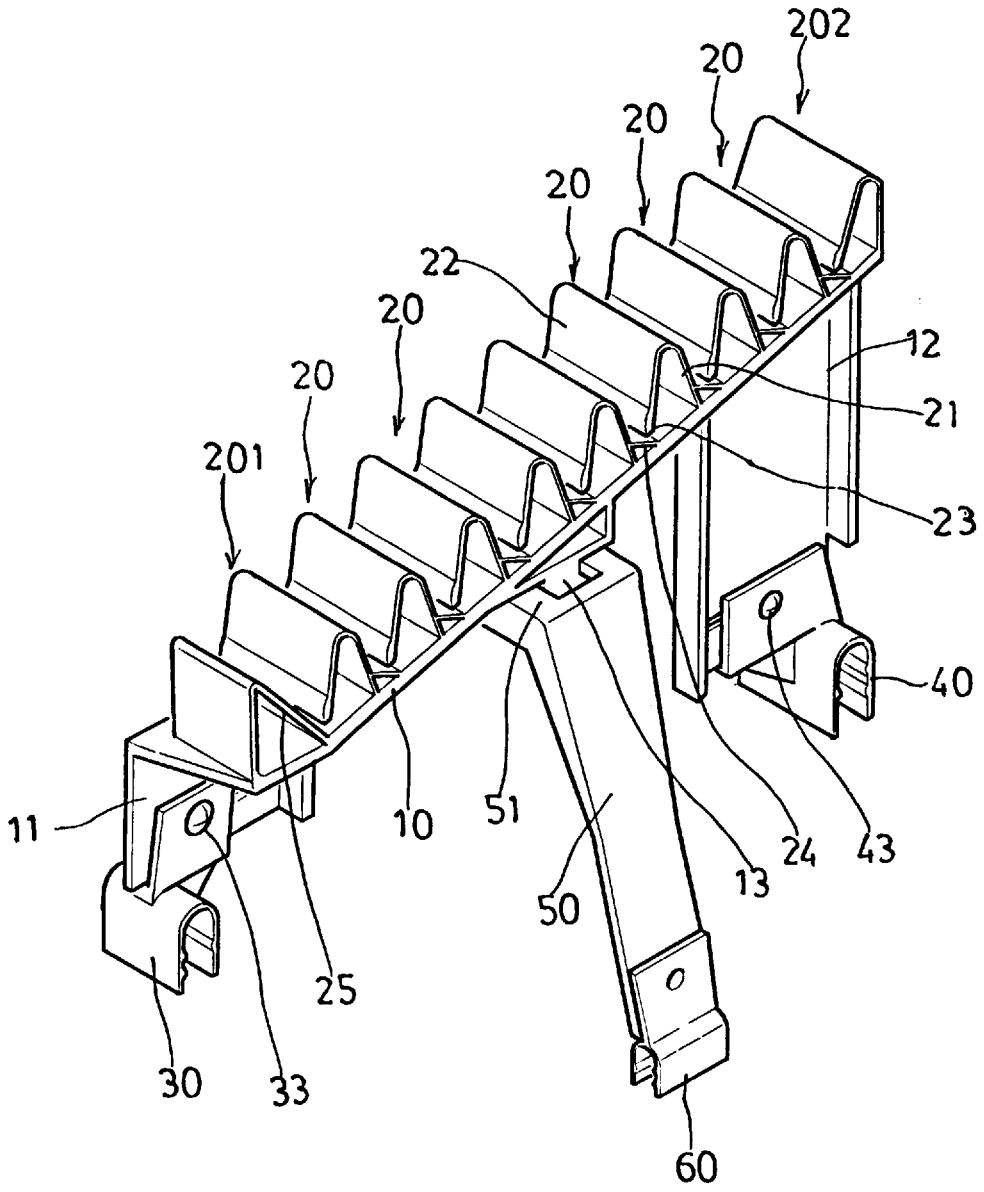
FIG. 1 is a perspective view of the preferred embodiment of the present invention.
Figure 3:
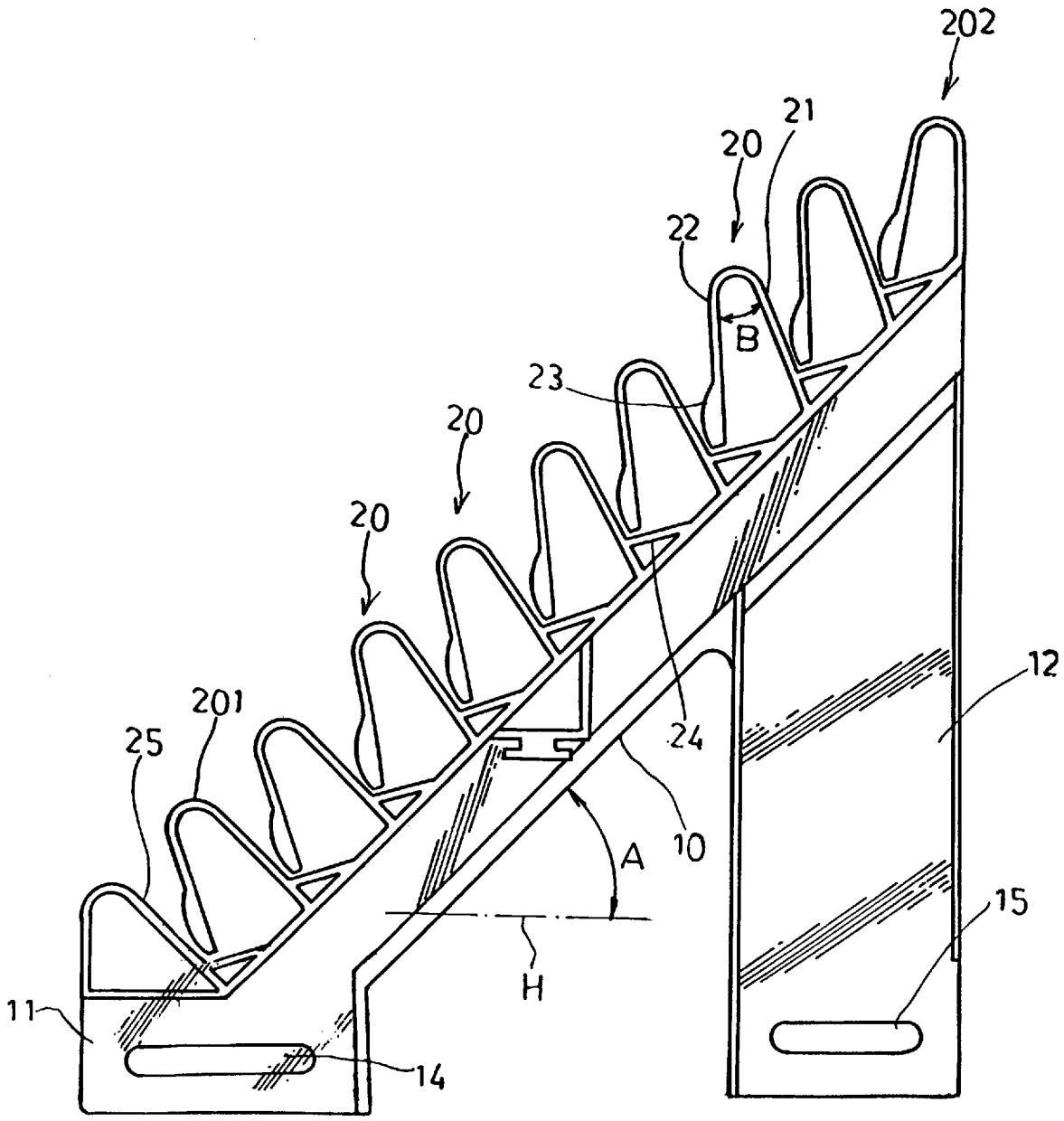
FIG. 3 is a front view of the tilted base plate of the present invention.

Referring to FIG. 1, a tilted base plate 10 of suitable length and width is provided in the present invention. As is shown in FIG. 3, the tilted base plate 10 preferably forms an angle of 45 degrees with a horizontal line H. Thus, when placed on the round mouth of a golf bag, such an angle can allow the tilted base plate 10 to have a longest angled length within the round periphery of the mouth for dividing it into a plurality of clamping portions. As is shown in this drawing, nine clamping portions can be formed to clamp nine golf clubs.

The tilted base plate 10 is provided with a plurality of elastic clips 20 along the length thereof to form the clamping portions. These elastic clips 20 are formed by extensions 21 of the tilted base plate. The extensions 21 are folded back downwards to form their respective pending portions 22 while keep a short distance from the surface of the tilted base plate 10. A plurality of reinforcing bevel sheets 24 are provided under the bottom ends 23 of the pending portions 22 respectively. The reinforcing bevel sheets 24 are tilted and integrally connected to the surface of the tilted base plate 10 and their corresponding extensions 21.

To form a complete club hanger device with elastic clips, a fixed tilted sheet 25 is provided at the outer side of the leftmost elastic clip 201, while the rightmost elastic clip 202 is formed directly by folding the right end of the tilted base plate 10.

Referring to FIG. 3, in addition to the angle A of 45 degrees formed between the tilted base plate 10 and the horizontal line H, the extensions 21 of the elastic clips 20 each forms an angle B with its respective pending portion 22 folded back as is stated above. The angle B is smaller for the rightmost elastic clip 202 formed directly by folding the right end of the tilted base plate 10. Every angle B is different depending on the number of the golf club to be placed therein. Therefore, the clamping space and clamping force for each of the elastic clips 21 is slightly different. The value of each angle is most preferably from 18 to 25 degrees. In the embodiment shown in this drawing, the values of the angles B diminish from the lowermost to the uppermost.

Figure 2:
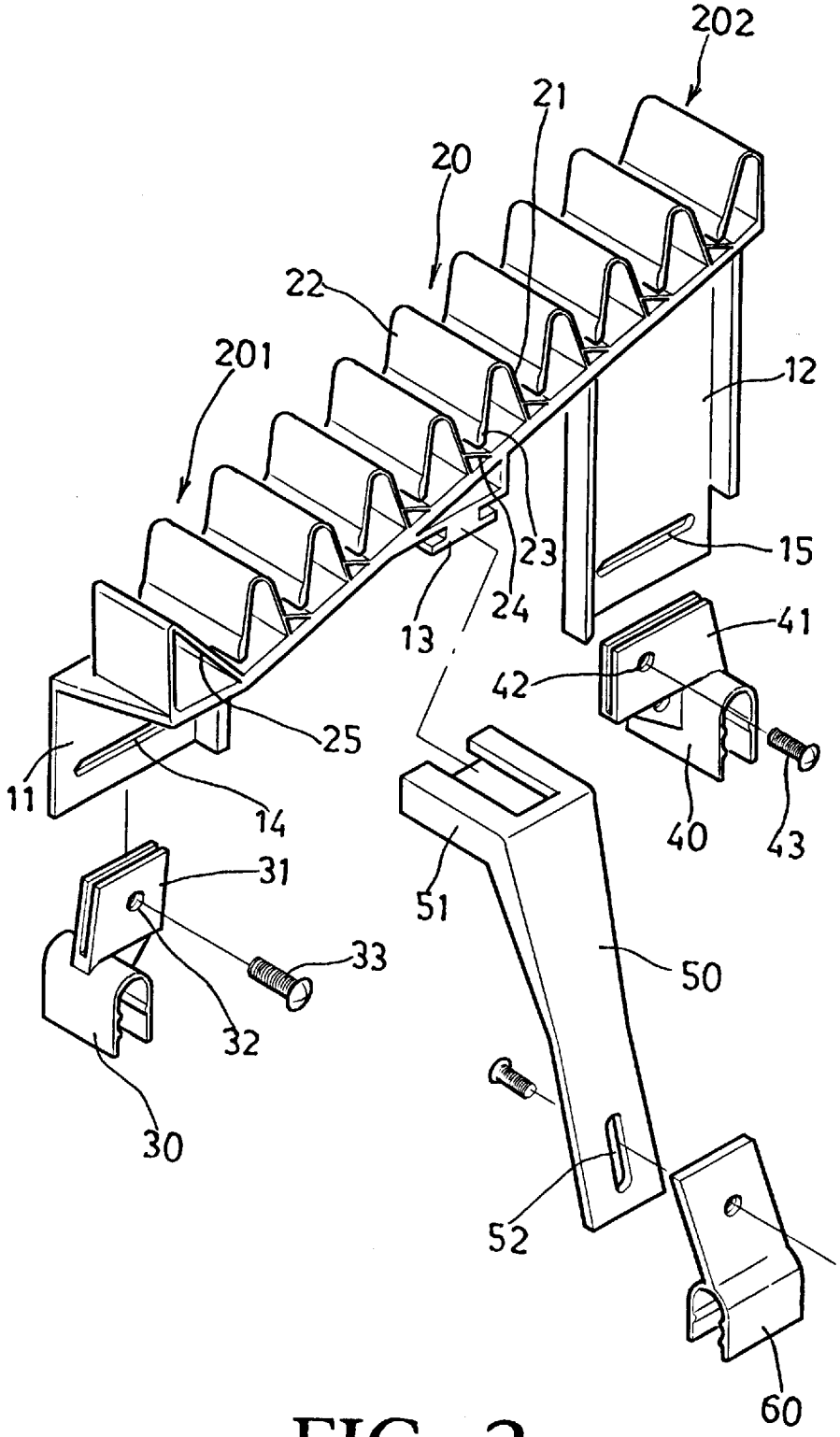
FIG. 2 is a perspective exploded view of the elements composing the embodiment of FIG. 1.

Referring to FIG. 2, a short sheet bracket 11 and a long sheet bracket 12 extend downwardly on the two ends of the tilted base plate 10, and a slide connecting seat 13 extends downwardly at the middle of the tilted base plate 10. The short sheet bracket 11 and the long sheet bracket 12 are provided respectively with a horizontal slot 14 and 15. In the embodiment shown in this drawing, the short sheet bracket 11 and the long sheet bracket 12 mount respectively a clamps 30 and 40 integrally connected with clamping sheet 31 and 41 respectively thereabove for clamping on the slot 14 and 15 respectively. The clamping sheets 31 and 41 are provided respectively with a through hole 32 and 42. Bolts 33 and 43 can be extended through the holes 32 and 42. and the slot 14 and 15 respectively for positioning of the short sheet bracket 11 and the long sheet bracket 12. The slide connecting seat 13 can be used for connecting an angularly extending member 50 to the tilted base plate 10. The top of the middle member 50 is provided thereof with a slide connecting portion 51 for connecting with the slide connecting seat 13. A slot 52 is provided on the lower end of the middle member 50 for fastening another clamp 60.

Figure 4:
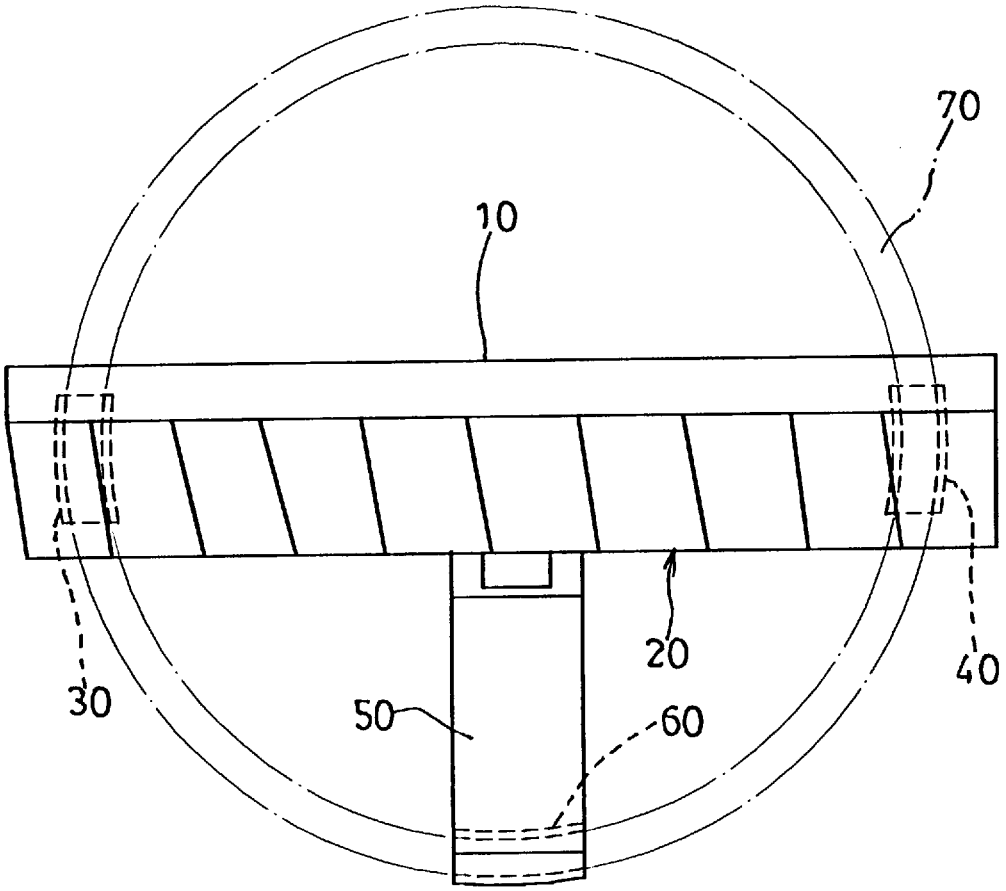
FIG. 4 is a top view of the present invention when it straddles the top of a golf bag.
Figure 6:
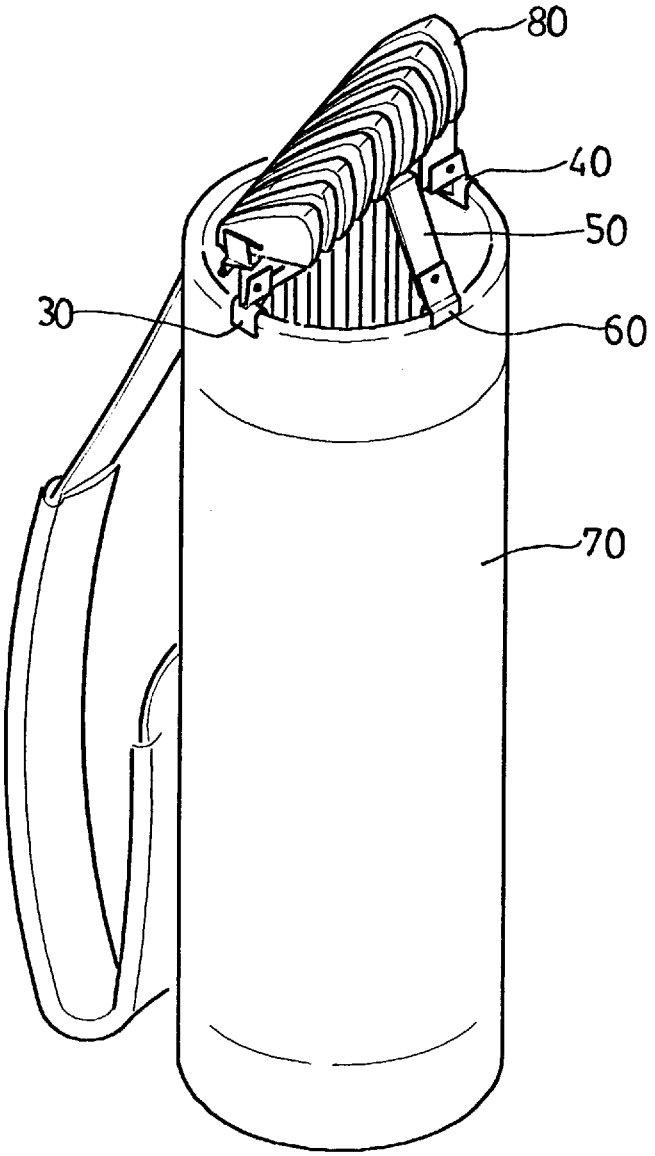
FIG. 6 is a schematic view showing mounting of the present invention onto a golf bag.

As shown in FIG. 4, when the device of the present invention is mounted on the mouth of a golf bag 70, the above mentioned clamps 30 and 40 and the clamp 60 for the middle member 50 can clamp the periphery of the golf bag 70 to form a three point supporting structure. Thus, the whole hanger device is secured on the top of the golf bag 70. Therefore as is shown in FIG. 6, golf clubs 80 of different numbers can be inserted in the appointed positions in the golf bag 70.

Figure 5:
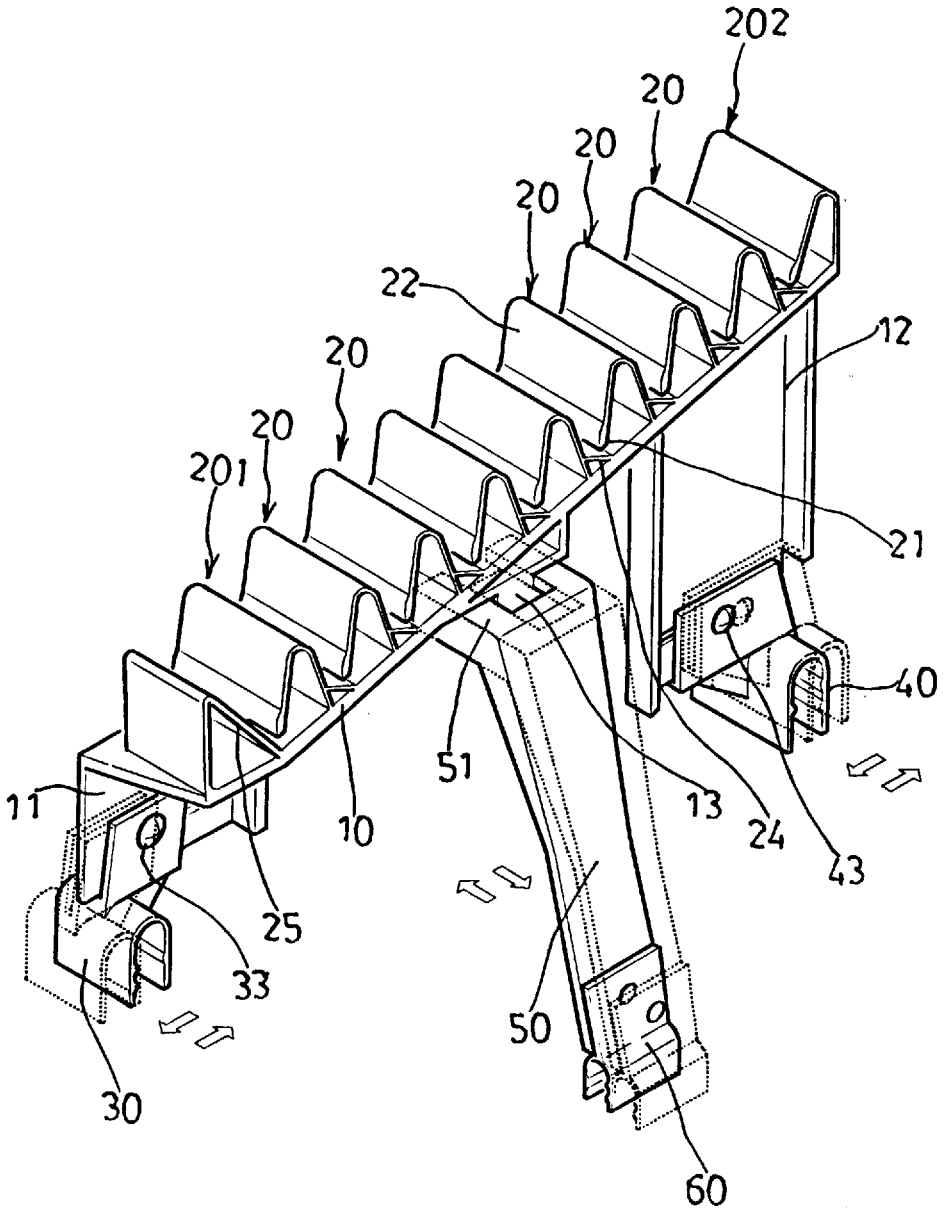
FIG. 5 is a schematic view showing adjustment of the related members as shown in FIG. 1.

As shown in FIG. 5, the clamps 30 and 40 at the two ends are connected with the slots 14 and 15 on the sheet brackets 11 and 12 on the two ends of the tilted base plate 10. They can be located at different positions depending on the positions of a positioning lock, and they can provide different widths for clamping. The middle member 50 connects by the top slide connecting portion 51 thereof to the slide connecting seat 13 of the tilted base plate 10. Therefore, the clamp 60 at the bottom thereof can have different radial positions depending on the slide connection positions thereof on the slide connecting seat 13. Hence the whole hanger device can be assembled to the peripheries of various golf bags 70.

Figure 7:
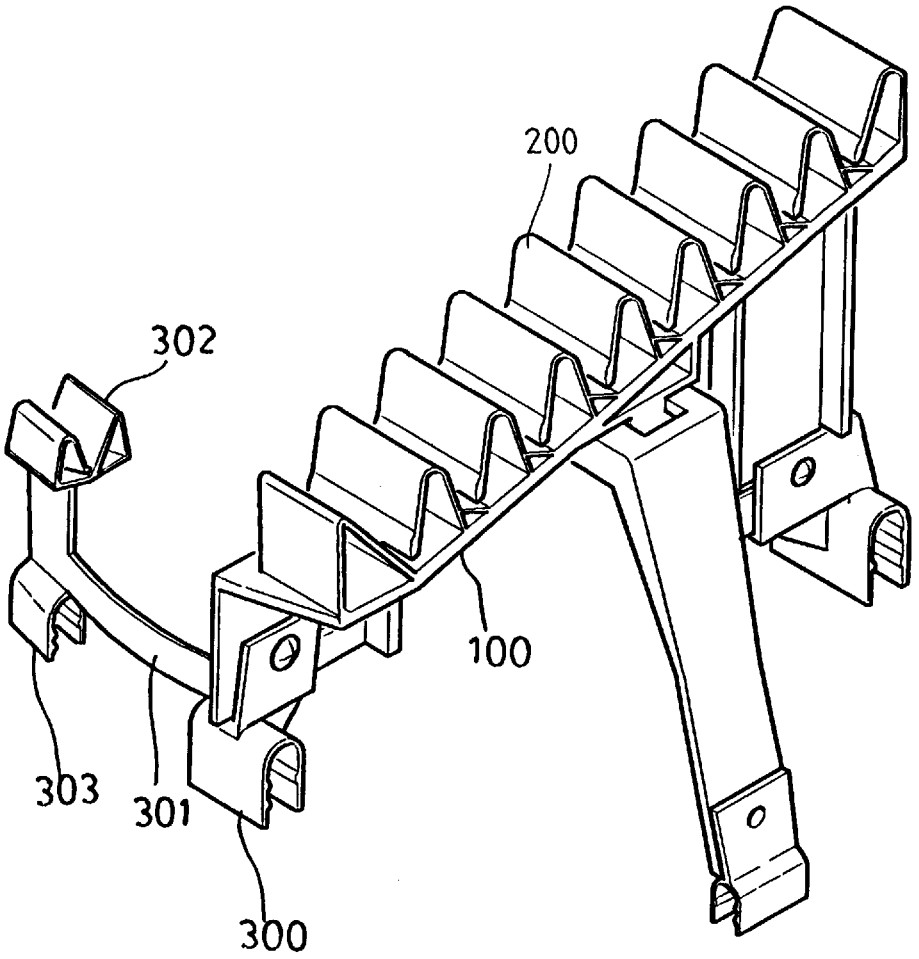
FIG. 7 is a perspective view of another embodiment of the present invention.
Figure 8:
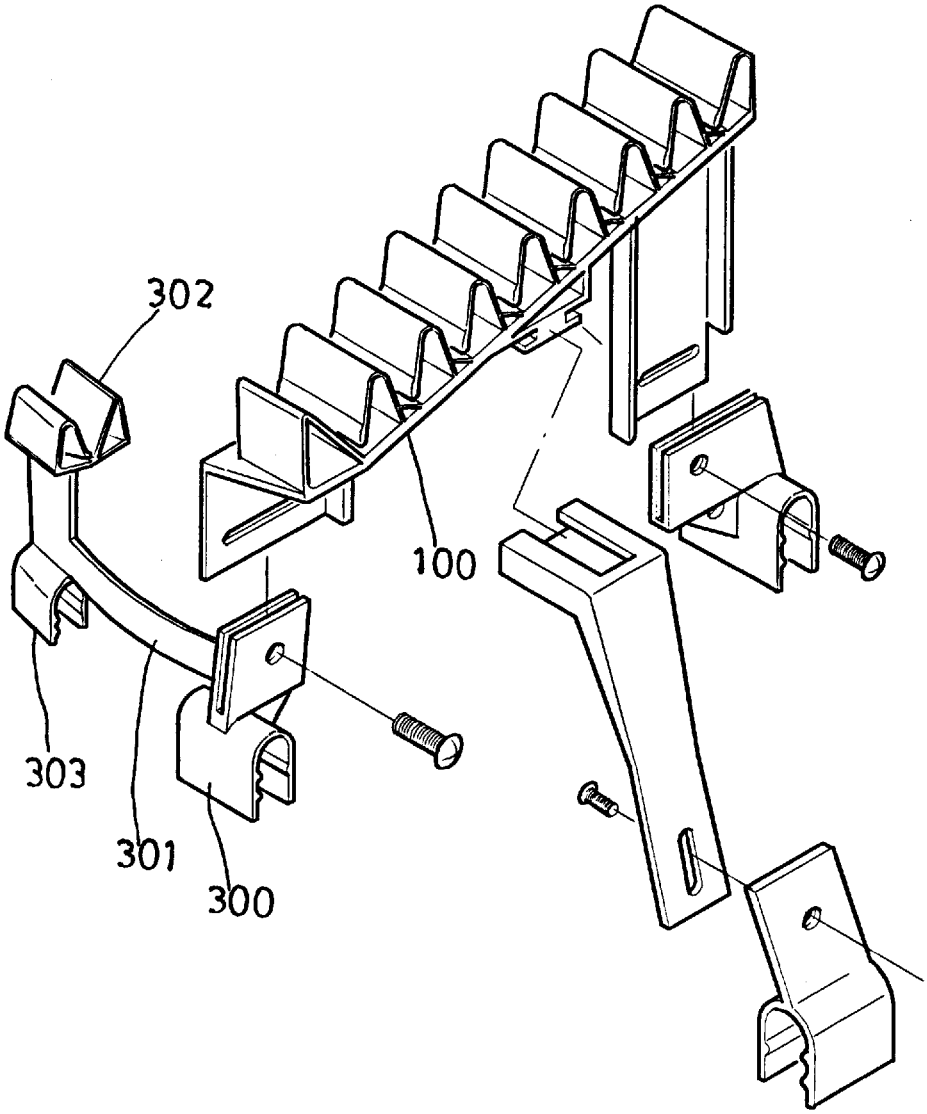
FIG. 8 is a perspective view exploded of the elements composing the embodiment of FIG. 7.
Figure 9:
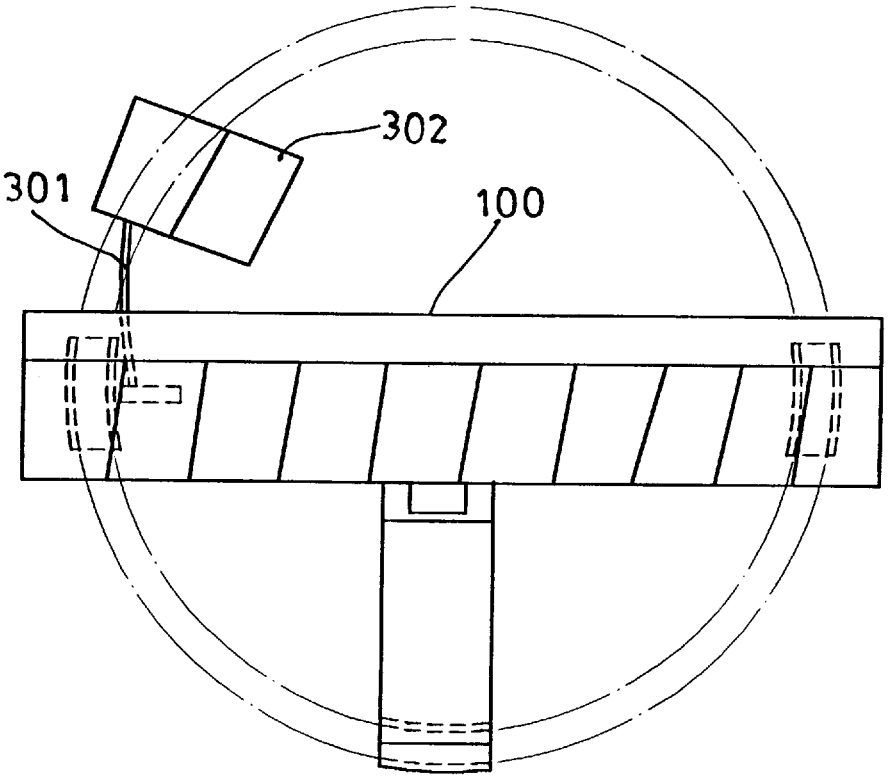
FIG. 9 is a top view showing mounting of the embodiment of FIG. 7 on the top of a golf bag.

FIG. 7 to 9 disclose another embodiment of the present invention, wherein, the device of the present invention suits golf bags of specific diameters, such as 8½ inches. In this embodiment, the number of the elastic clips 200 or the clamping portions on the tilted base plate 100 can be reduced slightly to eight, and the end clamp 300 is integrally provided with a connecting strip 301. The connecting strip 301 is further provided with an upper elastic clip set 302 and a lower clamp 303. The upper elastic clip set 302 is used to clamp a specific club (such as a sand club, i.e. an S club).

The present invention provides a plurality of elastic clips which are preformed integrally with the tilted base plate. Due to the fixed positions of the elastic clips, various golf clubs can be sorted and placed systematically therein. The elastic clips provide different clamping angles to firmly secure the various clubs with suitable clamping force in position. Not only is sorting and placing of the golf clubs convenient, damage of the clubs by collision among the club heads due to movement of the clubs can be effectively eliminated. The whole club hanger device can suit various sizes of golf bags.

Having thus described the technical structure of my invention with practicability and improvableness, what I claim as new and desire to be secured by Letters Patent of the United States is:

1. A device for systematically hanging golf clubs in a golf bag having a top, comprising, in combination: a base plate; a plurality of clamps for clamping on the top of the golf bag, with the clamps mounted to the base plate, with the base plate including a surface; and a plurality of elastic clips for clamping the golf clubs, with said elastic clips being formed by extensions of said base plate, said extensions being folded back downwards to form respective pending portions which all keep a short distance from the surface of said base plate, with angles being formed between said extensions and said pending portions folded back from said extensions of each of the plurality of elastic clips.

2. A systematic iron golf club hanger device as claimed in claim 1 wherein the angles of the plurality of elastic clips have different values for clamping different golf clubs.

3. A systematic iron golf club hanger device as claimed in claim 2 wherein the values of the angles of the plurality of elastic clips range from 18 to 25 degrees.

4. A systematic iron golf club hanger device as claimed in claim 2 wherein the base plate has first and second ends, with the values of the angles of the plurality of elastic clips diminishing from the first end of the base plate to the second end thereof.

5. A systematic iron golf club hanger device as claimed in claim 4 wherein the values of the angles of the plurality of elastic clips range from 18 to 25 degrees.

6. A systematic iron golf club hanger device as claimed in claim 1 wherein the base plate is tilted relative to a horizontal plane.

7. A systematic iron golf club hanger device as claimed in claim 6 wherein the base plate forms an angle of 45 degrees with said horizontal plane.

8. A systematic iron golf club hanger device as claimed in claim 1 wherein said base plate has two ends each including a downwardly extending sheet bracket for connecting to one of the plurality of clamps.

9. A systematic iron golf club hanger device as claimed in claim 8 wherein each of the plurality of clamps includes a clamping sheet provided with a through hole, with the sheet brackets each provided with a slot; and wherein the systematic iron golf club hanger device further comprises, in combination: bolts extending through the through holes of the clamping sheets and through the slots.

10. A systematic iron golf club hanger device as claimed in claim 8 further comprising, in combination: an angularly extending member having a top, with the base plate having a middle; a slide connecting seat extending downwardly at the middle of the base plate; and a slide connecting portion provided on the top of the angularly extending member for connecting with the slide connecting seat, with the angularly extending member connecting to one of the plurality of clamps.

11. A systematic iron golf club hanger device as claimed in claim 10 wherein each of the plurality of clamps includes a clamping sheet provided with a through hole, with the sheet brackets and the angularly extending member each provided with a slot; and wherein the systematic iron golf club hanger device further comprises, in combination: bolts extending through the through holes of the clamping sheets and through the slots.

12. A systematic iron golf club hanger device as claimed in claim 1 wherein the base plate includes an end provided with one of the plurality of clamps further provided integrally with an elastic clip set for clamping the golf clubs and with another clamp for clamping the top of the golf bag.

13. A systematic iron golf club hanger device as claimed in claim 1 further comprising, in combination: a plurality of reinforcing bevel sheets provided slightly under the pending portions of the plurality of elastic clips respectively, said reinforcing bevel sheets extending between and integrally connected to the surface of said base plate and the corresponding extension of the plurality of elastic clips.

14. A systematic iron golf club hanger device as claimed in claim 1 further comprising, in combination: an angularly extending member having a top, with the base plate having a middle; a slide connecting seat extending downwardly at the middle of the base plate; and a slide connecting portion provided on the top of the angularly extending member for connecting with the slide connecting seat, with the angularly extending member connecting to one of the plurality of clamps.

15. A systematic iron golf club hanger device as claimed in claim 14 wherein the clamp of the angularly extending member includes a clamping sheet provided with a through hole, with the angularly extending member provided with a slot; and wherein the systematic iron golf club hanger device further comprises, in combination: a bolt extending through the through hole of the clamping sheet and through the slot.

16. A device for systematically hanging golf clubs in a golf bag having a top, comprising, in combination: a base plate having first and second ends and a middle; first and second clamps provided on the first and second ends of the base plate for clamping the top of the golf bag; a plurality of elastic clips provided on the base plate for clamping the golf clubs; an angularly extending member having a top; a slide connecting seat extending downwardly at the middle of the base plate; a slide connecting portion provided on the top of the angularly extending member for connecting with the slide connecting seat; and a third clamp provided on the angularly extending member for clamping the top of the golf bag.

17. A systematic iron golf club hanger device as claimed in claim 16 wherein the first and second ends of the base plate each include a downwardly extending sheet bracket for connecting to the respective first and second clamps.

18. A systematic iron golf club hanger device as claimed in claim 17 wherein each of the clamps includes a clamping sheet provided with a through hole, with the sheet brackets and the angularly extending member each provided with a slot; and wherein the systematic iron golf club hanger device further comprises, in combination: bolts extending through the through holes of the clamping sheets and through the slots.

19. A systematic iron golf club hanger device as claimed in claim 16 wherein the first clamp is integrally provided with an elastic clip set for clamping the golf clubs and with another clamp for clamping the top of the golf bag.

20. A systematic iron golf club hanger device as claimed in claim 16 wherein the third clamp of the angularly extending member includes a clamping sheet provided with a through hole, with the angularly extending member provided with a slot; and wherein the systematic iron golf club hanger device further comprises, in combination: a bolt extending through the through hole of the clamping sheet and through the slot.

* * * * *